US010770245B2

(12) United States Patent
Koyama et al.

(10) Patent No.: US 10,770,245 B2
(45) Date of Patent: Sep. 8, 2020

(54) CONTACT STRUCTURE FOR SWITCH, TRIGGER SWITCH AND ELECTRIC POWER TOOL

(71) Applicant: Omron Corporation, Kyoto (JP)

(72) Inventors: Taiki Koyama, Okayama (JP); Shigenobu Kishi, Okayama (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 16/347,293

(22) PCT Filed: Oct. 19, 2017

(86) PCT No.: PCT/JP2017/037895

§ 371 (c)(1),
(2) Date: May 3, 2019

(87) PCT Pub. No.: WO2018/123223

PCT Pub. Date: Jul. 5, 2018

(65) Prior Publication Data

US 2019/0279831 A1 Sep. 12, 2019

(30) Foreign Application Priority Data

Dec. 28, 2016 (JP) ..... 2016-255779

(51) Int. Cl.

| | |
|---|---|
| ***H01H 13/64*** | (2006.01) |
| ***H01H 13/14*** | (2006.01) |
| ***H01H 13/52*** | (2006.01) |
| ***H01H 1/50*** | (2006.01) |
| ***B25F 5/00*** | (2006.01) |
| ***H01H 13/02*** | (2006.01) |
| *H01H 13/04* | (2006.01) |

(52) U.S. Cl.

CPC ..... *H01H 13/64* (2013.01); *B25F 5/00* (2013.01); *H01H 1/50* (2013.01); *H01H 13/02* (2013.01);

(Continued)

(58) Field of Classification Search

CPC ..... H01H 13/64; H01H 1/50; H01H 13/02; H01H 13/14; B25F 5/00

(Continued)

(56) References Cited

U.S. PATENT DOCUMENTS 6,717,080 B1 * 4/2004 Chan ..... H01H 13/08 200/200
2006/0186102 A1 8/2006 Inagaki et al.

(Continued)

FOREIGN PATENT DOCUMENTS

CN 103659750 A 3/2014
CN 105378882 A 3/2016

(Continued)

OTHER PUBLICATIONS

International Search Report issued in Application No. PCT/JP2017/037895, dated Jan. 23, 2018 (2 pages).

(Continued)

*Primary Examiner* — Nguyen Tran
*Assistant Examiner* — Iman Malakooti
(74) *Attorney, Agent, or Firm* — Osha Liang LLP

(57) ABSTRACT

The switch opening-closing mechanism, which makes it possible to increase a contact force so as to improve a vibration resistance, includes a sliding part, a second movable piece, and a second fixed contact. In a case where an amount of movement of a sliding part reaches a second retraction amount, the second movable piece comes into contact with the second fixed contact due to a spring force applied to the second movable piece. In a case where the amount of movement of the sliding part reaches a third retraction amount which is larger than a second retraction amount, the sliding part presses the second movable piece against the second fixed contact.

14 Claims, 8 Drawing Sheets

(52) U.S. Cl.
CPC ..... *H01H 13/14* (2013.01); *H01H 13/52* (2013.01); *H01H 13/04* (2013.01); *H01H 2225/01* (2013.01); *H01H 2231/048* (2013.01); *H01H 2239/078* (2013.01)

(58) Field of Classification Search
USPC ..... 200/42.01
See application file for complete search history.

(56) References Cited

U.S. PATENT DOCUMENTS

| | | | | |
|---|---|---|---|---|
| 2013/0037398 | A1* | 2/2013 | Kobayashi | H01H 9/04 200/306 |
| 2016/0365202 | A1 | 12/2016 | Koyama et al. | |

FOREIGN PATENT DOCUMENTS

| | | | | |
|---|---|---|---|---|
| EP | 2709133 | A1 | 3/2014 | |
| JP | S58-51529 | U | 4/1983 | |
| JP | 06223674 | * | 8/1994 | H01H 13/20 |
| JP | H06-223674 | A | 8/1994 | |
| JP | 2006-221908 | A | 8/2006 | |
| JP | 2015-99645 | A | 5/2015 | |

OTHER PUBLICATIONS

Written Opinion issued in International Application No. PCT/JP2017/037895, dated Jan. 23, 2018 (9 pages).
Office Action issued in the counterpart Chinese Patent Application No. 201780067065.X, dated Jan. 10, 2020 (11 pages).

* cited by examiner

CONTACT STRUCTURE FOR SWITCH, TRIGGER SWITCH AND ELECTRIC POWER TOOL

TECHNICAL FIELD

The present invention relates to a switch contact structure, a trigger switch, and an electric power tool.

BACKGROUND ART

According to an increase in output of an electric power tool, the level of vibration of the tool has been increased. A contact force of a switch is therefore more necessary than before. As a conventional technique for increasing a contact force, for example, a trigger switch disclosed in Patent Literature 1 is known. The term "contact force" means a force by which a contact of a switch is pressed against the other contact.

As illustrated in (a) of FIG. 10, a trigger switch 100 disclosed in Patent Literature 1 includes (i) a first movable contact 111 which is provided at one end part and (ii) a second movable contact 112 which is provided at the other end part. The trigger switch 100 further includes (i) a movable contact piece 110 configured to turn while being supported at the support member 101, (ii) a slide member 102 configured to slide while pressing a slide surface 113 of the movable contact piece 110 so that the slide member 102 causes the movable contact piece 110 to turn in a seesaw-like pattern, (iii) a first terminal 103 having a first fixed contact 103*a*, (iv) a second terminal 104 having a second fixed terminal 104*a*, and (v) a plunger 106 configured to cause the slide member 102 to move horizontally.

As illustrated in (b) of FIG. 10, in a case where the trigger switch 100 thus configured pushes the plunger 106 in, the slide member 102 slides in a rightward direction on the slide surface 113. When the slide member 102 passes a protruding support point 113*a* provided on the slide surface 113, the movable contact piece 110 turns so that the second movable contact 112 comes into contact with the second fixed terminal 104*a*.

As illustrated in (c) of FIG. 10, in a case where the plunger 106 is further pushed in, the slide member 102 further slides in the rightward direction on the slide surface 113. Then, in a case where the slide member 102 reaches a top portion 113*b* of the slide surface 113 at the movable contact piece 110, the pressing force of the slide member 102 increases. This causes the second movable contact 112 and the second fixed terminal 104*a* to be firmly in contact with each other.

According to the trigger switch 100 thus configured, the contact force between the second movable contact 112 and the second fixed terminal 104*a* can be increased so as to improve a vibration resistance.

CITATION LIST

Patent Literature

[Patent Literature 1]
Japanese Patent Application Publication, Tokukai, No. 2015-99645 (Publication Date: May 28, 2015)

SUMMARY OF INVENTION

Technical Problem

However, since a seesaw contact is used according to the conventional trigger switch 100, tactile feedback occurs in the process of operation. The seesaw contact is therefore not suitable for a speed-change switch which is configured so that an output of a target of driving increases in response to a retraction amount of a trigger. Therefore, in order to remove tactile feedback in a seesaw contact method, it is necessary to, for example, add another component.

Furthermore, although a large contact force can be achieved with the conventional trigger switch 100, the pressure of the plunger 106 accordingly becomes large and the resistance to the sliding becomes large. This unfortunately causes the operating load to become large or leads to a deterioration of operational feeling.

An object of an aspect of the present invention is to provide a switch contact structure, a trigger switch, and an electric power tool, each of which can increase a contact force so as to improve a vibration resistance.

Solution to Problem

A switch contact structure in accordance with an aspect of the present invention includes: an operation section; a first movable contact member; and a first counter contact member configured to face the first movable contact member, in a case where an amount of movement of the operation section reaches a first movement amount, the first movable contact member coming into contact with the first counter contact member due to a spring force applied to the first movable contact member, and in a case where the amount of movement of the operation section reaches a second movement amount which is larger than the first movement amount, the operation section pressing the first movable contact member against the first counter contact member.

A trigger switch in accordance with an aspect of the present invention can be configured to include: the contact structure in accordance with the aspect of the present invention, the operation section being configured to move in coordination with a trigger operated by a user.

An electric power tool in accordance with an aspect of the present invention can be configured to include the trigger switch in accordance with the aspect of the present invention.

Advantageous Effects of Invention

With an aspect of the present invention, it is possible to increase a contact force so as to improve a vibration resistance.

Figure 10:
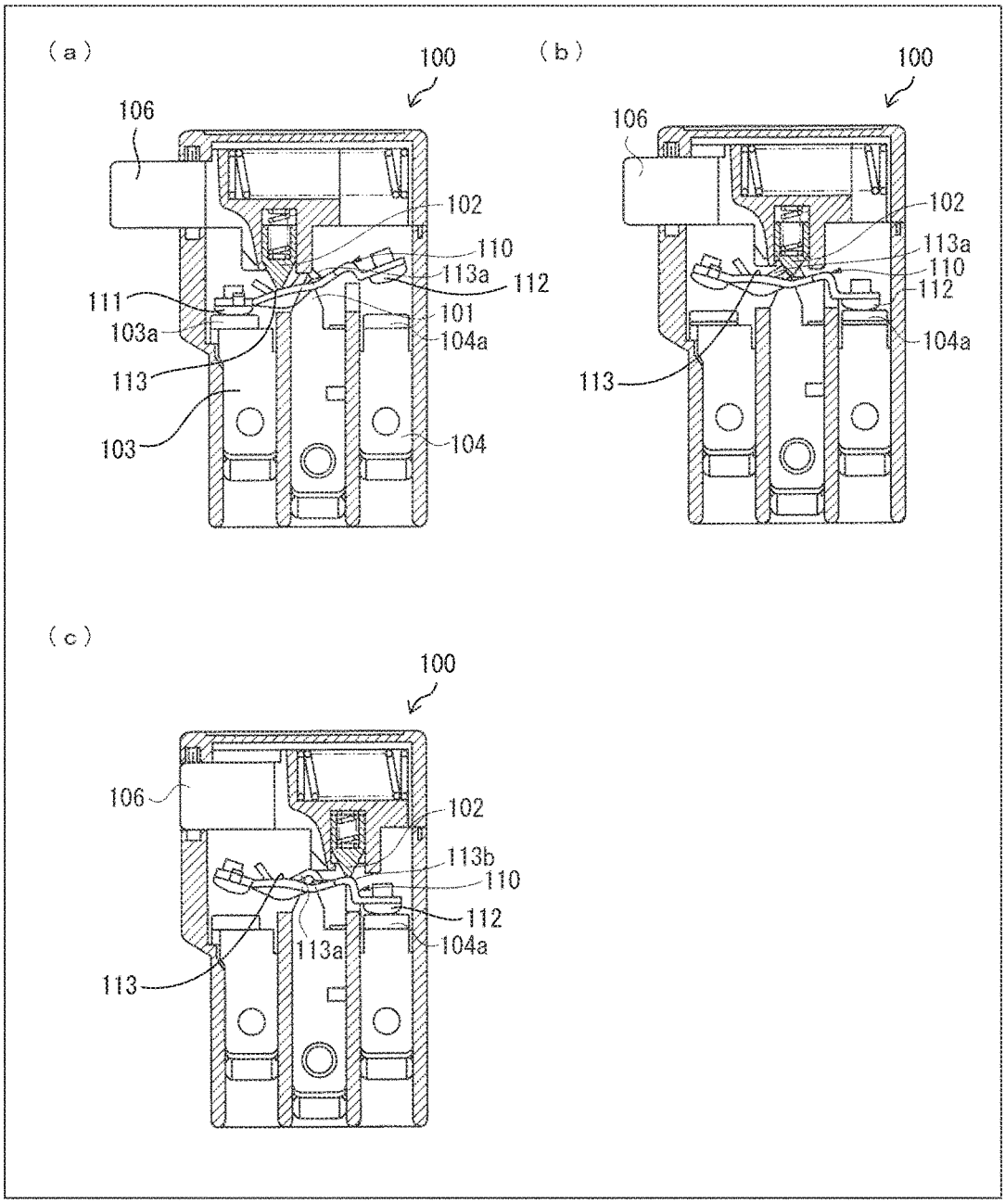

(a) of FIG. 10 is a left side cross-sectional view which illustrates a configuration of a conventional trigger switch having a seesaw contact and which shows that a contact of the trigger switch is opened. (b) of FIG. 10 is a left side cross-sectional view showing that the contact of the trigger switch is closed. (c) of FIG. 10 is a left side cross-sectional view showing that the contact force is increased while the contact is closed.

DESCRIPTION OF EMBODIMENTS

The following description will discuss an embodiment of the present invention with reference to FIGS. 1 through 9. In the following description, a trigger switch provided in an electric power tool will be described. The electric power tool includes the trigger switch. The trigger switch in accordance with the present embodiment is to be used for an electric power tool such as an impact wrench.

Figure 2:
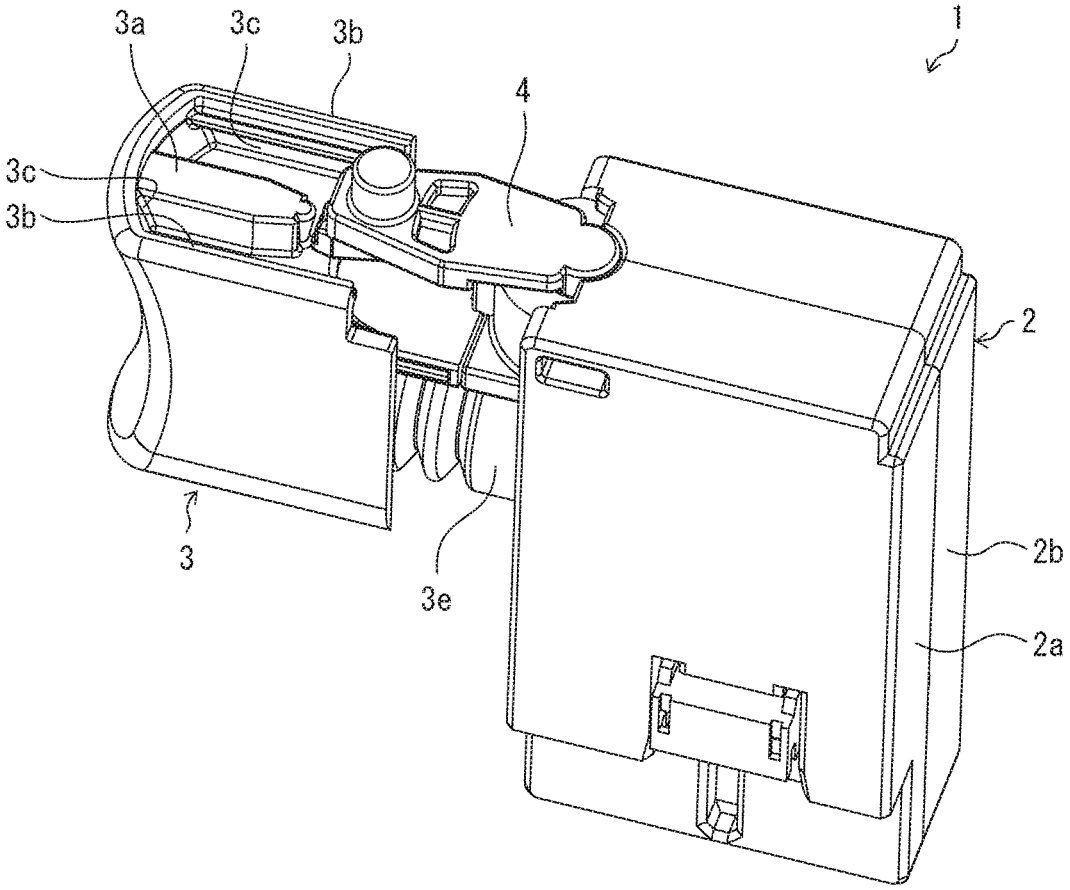
FIG. 2 is a perspective view illustrating a configuration of the trigger switch.
Figure 3:
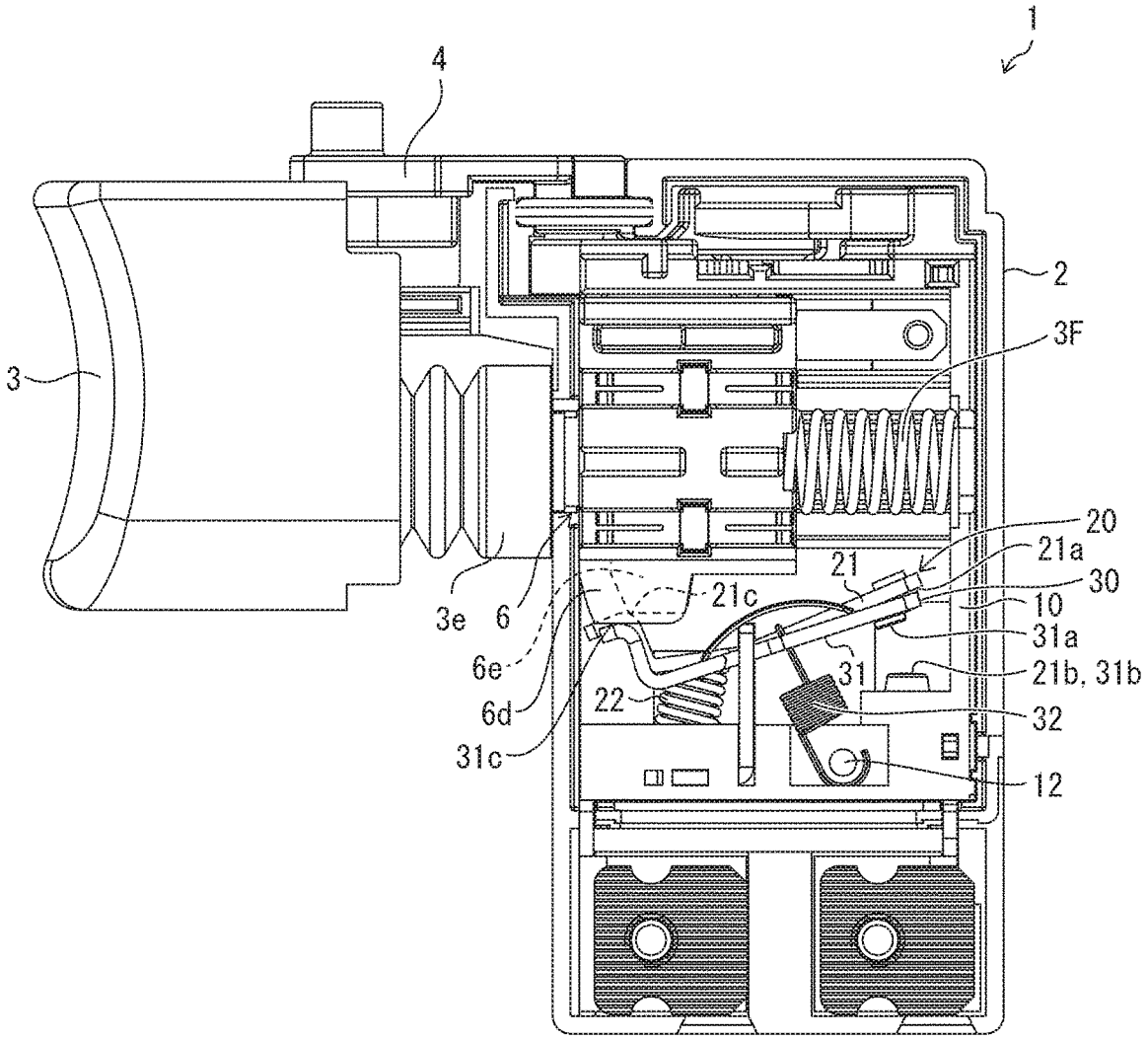
FIG. 3 is a left side view illustrating the configuration of the trigger switch and showing that respective contacts of the first switch and of the second switch are both opened.
Figure 4:
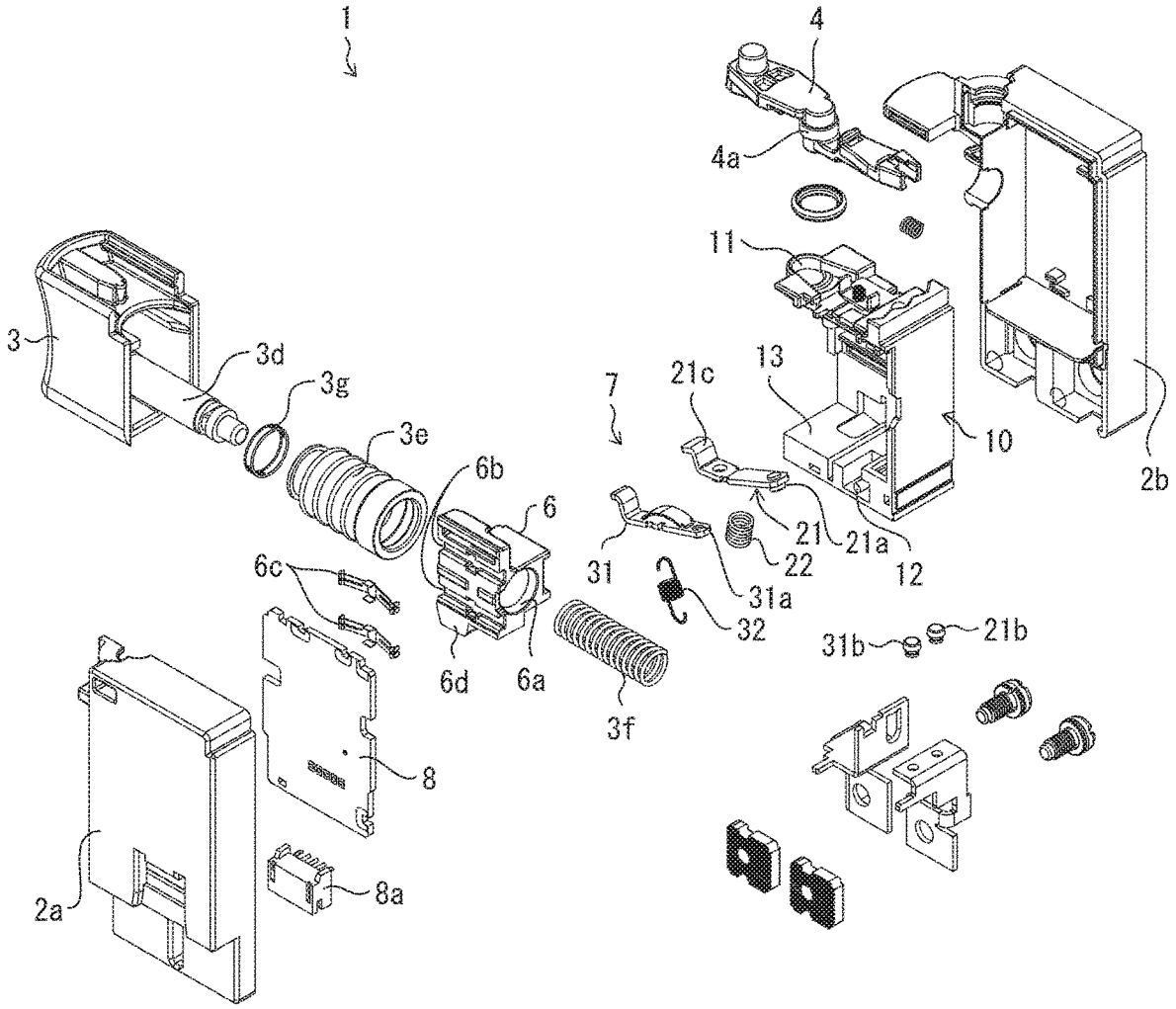
FIG. 4 is an exploded perspective view illustrating the configuration of the trigger switch.

FIG. 2 is a perspective view illustrating a configuration of a trigger switch 1 in accordance with the present embodiment. FIG. 3 is a left side view illustrating the configuration of the trigger switch 1 and showing that respective contacts of a first switch and of a second switch are both opened. FIG. 4 is an exploded perspective view illustrating the configuration of the trigger switch 1.

As illustrated in FIG. 2, the trigger switch 1 in accordance with the present embodiment includes (i) a housing 2 formed by causing a left-side cover 2*a* and a right-side cover 2*b*, which are box-shaped, to face each other and (ii) a trigger 3 provided so as to protrude toward a front surface from the housing 2 and to retract toward the housing 2. Above the housing 2, a switching lever 4 is provided. In the present embodiment, a side of the trigger switch 1, on which side the trigger 3 is provided, is a front side.

The switching lever 4 is configured to lock, while the trigger 3 is not operated, an extending movement of the trigger 3 by causing a tip part of the switching lever 4 to come into contact with a center protrusion 3*a* which is provided above the trigger 3. Meanwhile, in a case where the switching lever 4 is slightly turned clockwise or counter-clockwise, the tip part of the switching lever 4 loosely fits into a loose-fitting recess 3*c* which is provided between the center protrusion 3*a* and a side surface wall 3*b* above the trigger 3. This allows the trigger 3 to extend toward the housing 2.

As illustrated in FIGS. 3 and 4, the trigger 3 is provided in front of an upper part of the housing 2 and includes an operation shaft 3*d* which extends from the trigger 3 toward the housing 2. The operation shaft 3*d* is covered with an accordion-like cylindrical body 3*e*.

Inside the housing 2, the following are contained: (i) a base 10 configured to combine members together, (ii) a plunger 6 serving as a slide member, (iii) a switch opening-closing mechanism 7 serving as an opening-closing mechanism, (iv) a printed circuit board 8, and (v) the like.

As illustrated in FIG. 4, the base 10 has a shape made by cutting out one side surface from a box-like shape, and includes a positioning recess 11 which is provided at an upper front part of the base 10 and which is configured to position the switching lever 4. Below the base 10, the following are juxtaposed: (i) a positioning pin 12 configured to attach a second coil spring 32 (described later) and (ii) a mount 13 configured to restrict the position of the second movable piece 31.

As illustrated in FIG. 4, the plunger 6 has (i) a shape which allows the plunger 6 to slide in front and rear directions in the base 10, (ii) a through-hole 6*a* which passes through the plunger 6 in the front and rear directions, and (iii) a pair of guide grooves 6*b* and 6*b* on a left side surface of the plunger 6. Into the through-hole 6*a*, a resetting coil spring 3*f*, which is configured to cause the retracting trigger 3 to return, is to be inserted. Into the pair of guide grooves 6*b* and 6*b*, corresponding sliders 6*c* and 6*c* are fixed with a pressure. This allows the plunger 6 to (i) move backward in the base 10 in response to the trigger 3 retracting and (ii) return forward, by the return force of the resetting coil spring 3*f*, in response to the trigger 3 returning forward.

Figure 5:
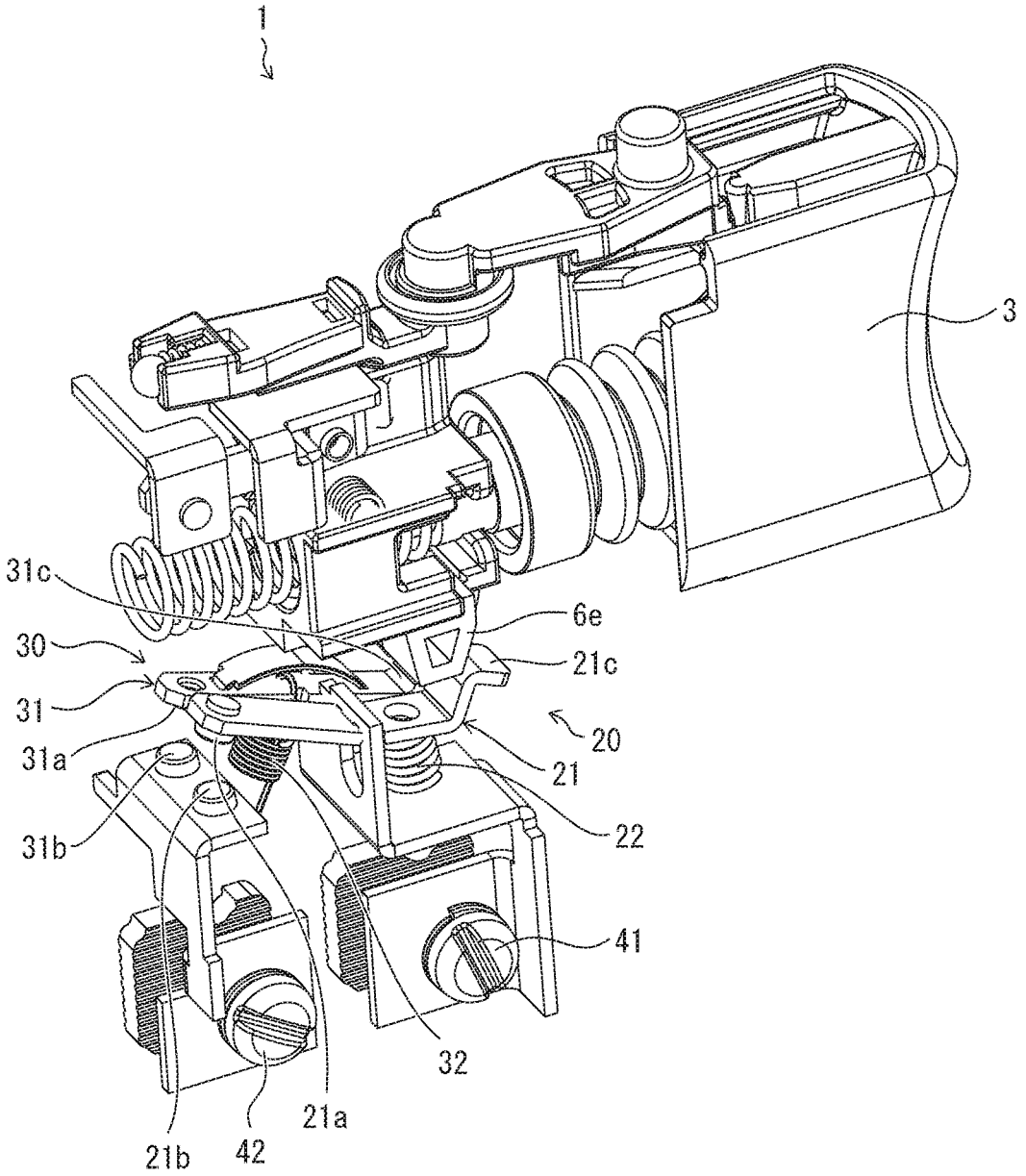
FIG. 5 is a perspective view which illustrates the configuration and main components of the trigger switch and in which it is viewed from a right surface side that respective contacts of the first switch and of the second switch are both opened.

As illustrated in FIG. 3, from a bottom surface of the plunger 6, sliding parts 6*d* and 6*e* having respective taper surfaces protrude. The sliding part 6*d* is configured to slide the second movable piece 31 of the second switch 30. The sliding part 6*e* is configured to slide a first movable piece 21 of the first switch 20. The sliding part 6*d* extends longer than the sliding part 6*e* in the front and rear directions. As illustrated in FIG. 5 described later, the sliding part 6*e* extends shorter than the sliding part 6*d* in the front and rear directions. The plunger 6 and the sliding parts 6*d* and 6*e* constitute an operation section configured to move in coordination with the trigger 3 which is operated by a user.

As illustrated in FIG. 4, the printed circuit board 8 has a shape so as to be able to cover an opening of the base 10. The printed circuit board 8 has an inner-facing surface on which (i) a slide resistive element (not shown) is printed and (ii) a microcomputer is mounted. To a lower end part of the printed circuit board 8, a socket 8*a* is attached.

The printed circuit board 8 can be integrated with the base 10 by being fitted into and thus combined with the base 10 in which the plunger 6 is contained. In a case where the plunger 6 moves forward or backward, the pair of sliders 6*c* and 6*c* attached to the plunger 6 slide along the slide resistive element (not shown) of the printed circuit board 8. This allows a resistance of the slide resistive element to be changed, and therefore allows the trigger switch 1 to supply, to an electric power tool, an output which corresponds to the movement amount of the plunger 6, and ultimately corresponds to the retraction amount of the trigger 3.

The trigger 3 includes the operation shaft 3*d* which protrudes forward. One end part of the accordion-like cylindrical body 3*e* inserted into the operation shaft 3*d* is prevented from coming off by a ring 3*g*. The trigger 3 can be integrated with the plunger 6 by engaging, through sliding, a tip part of the operation shaft 3*d* with an engagement hole (not shown) of the plunger 6, the tip part being protruding from the accordion-like cylindrical body 3*e*.

The switching lever 4 can reverse the direction of rotation of a motor (not shown) by being turned with the turning shaft part 4*a* serving as a fulcrum.

According to the trigger switch 1 of the present embodiment, the switch opening-closing mechanism 7 (switch contact structure) includes the first switch 20 and the second switch 30.

Figure 6:
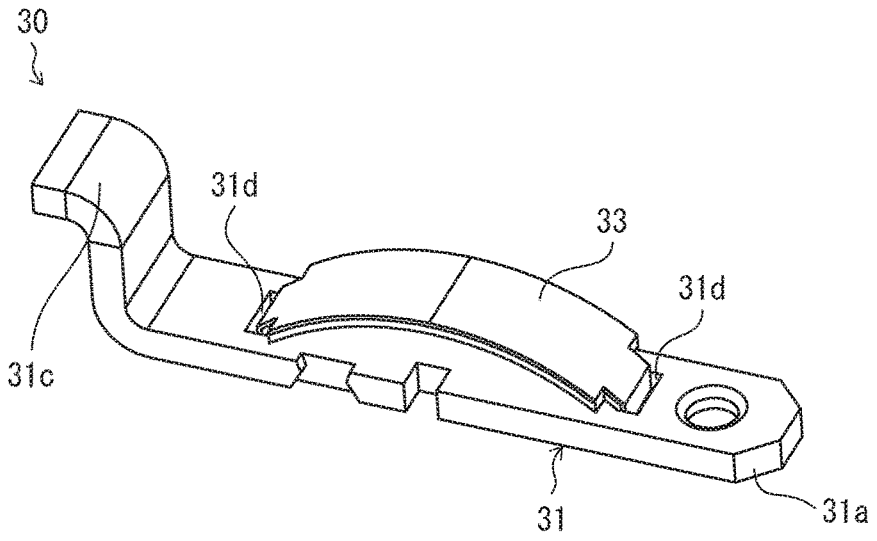
FIG. 6 is a perspective view illustrating the configuration of the second switch having a flat spring of the trigger switch.

FIG. 5 is a perspective view which illustrates the configuration and main components of the trigger switch 1 and in which it is viewed from a right surface side that respective contacts of the first switch 20 and of the second switch 30 are both opened. FIG. 6 is a perspective view illustrating the configuration of the second switch 30 having a flat spring of the trigger switch 1. The configurations of the first switch 20 and of the second switch 30 according to the present embodiment will be described below with reference to FIGS. 5 and 6.

As illustrated in FIG. 5, the first switch 20 includes (i) the first movable piece 21 (second movable contact member), (ii) a first movable contact 21*a* serving as a first opening-closing terminal provided at one end part of the first movable piece 21, (iii) a first fixed contact 21*b* (second counter contact member) serving as a first fixed terminal provided so as to face the first movable contact 21*a*, (iv) a first inhibiting part 21*c* provided at the other end part of the first movable piece 21 (opposite the one end part at which the first movable contact 21*a* is provided), and (v) a first coil spring 22 configured to elastically cause the first movable piece 21 to be in a closed state.

The second switch 30 includes (i) the second movable piece 31 (first movable contact member), (ii) a second movable contact 31*a* serving as a second opening-closing terminal provided at one end part of the second movable piece 31, (iii) a second fixed contact 31*b* (first counter contact member) serving as a second fixed terminal provided so as to face the second movable contact 31*a*, (iv) a second inhibiting part 31*c* provided at the other end part of the second movable piece 31 (opposite the one end part at which the second movable contact 31*a* is provided), and (v) a second coil spring 32 configured to elastically cause the second movable piece 31 to be in a closed state.

Note that the first movable contact 21*a* is configured by a silver (Ag) contact so that it is easy to stop arc discharge which occurs during an opening motion. Note, however, that a surface of the silver (Ag) contact is easily made rough by arc discharge. This causes a contact resistance to be large, and consequently causes stable contact to be difficult. According to the present embodiment, therefore, the first movable contact 21*a* opens and closes with timings different from those of the second movable contact 31*a*, so that arc discharge is prevented from occurring at one of the contacts. This increases a contact force at the second movable contact 31*a* in which a constantly-clean contact. Note, however, that because an increase in contact force stabilizes the contact, any one of the first movable contact 21*a* and the second movable contact 31*a* can be configured by a silver (Ag) contact. The term "contact force" means a force by which a contact of a switch is pressed against the other contact.

As illustrated in FIG. 5, (i) the first movable contact 21*a* is electrically connected to a negative electrode-side terminal 41 via the first movable piece 21 and (ii) the second movable contact 31*a* is electrically connected to the negative electrode-side terminal 41 via the second movable piece 31. Meanwhile, (i) the first movable contact 21*a* is electrically connected to a positive electrode-side terminal 42 via the first fixed contact 21*b* and (ii) the second movable contact 31*a* is electrically connected to the positive electrode-side terminal 42 via the second fixed contact 31*b*. The first fixed contact 21*b* and the second fixed contact 31*b* are electrically connected to each other. The first switch 20 and the second switch 30 are therefore connected in parallel. According to this configuration, even in a case where a vibration is applied to the trigger switch 1 while the trigger switch 1 is turned on (closed), the trigger switch 1 remains turned on so as to prevent the occurrence of arc discharge, unless the first switch 20 and the second switch 30 are both simultaneously opened. This allows for an increase in vibration resistance.

According to the present embodiment, in particular, the trigger switch 1 includes a flat spring 33 which is inserted into two attachment recesses 31*d* and 31*d* on an upper side of the second movable piece 31 of the second switch 30 (see FIG. 6). Note that the flat spring 33 has a curved shape while being unpressed. According to the trigger switch 1 of the present embodiment, the sliding part 6*d* of the plunger 6 slides on an upper surface of the flat spring 33 so as to press down the flat spring 33. Ultimately, the sliding part 6*d* elastically causes the second movable piece 31 to be in a closed state. This causes the second movable contact 31*a* to be pressed against the second fixed contact 31*b*. Consequently, a contact force between the second movable contact 31*a* and the second fixed contact 31*b* is increased. According to the present embodiment, the elastic member (flat spring 33) is made of, for example, steel so that the second movable piece 31 is elastically caused to be in a closed state. However, the material for the elastic member is not necessarily limited as such. Alternatively, for example, the elastic member can be made of a rubber or the like instead of the flat spring 33.

According to the present embodiment, the flat spring 33, which is an elastic body, is attached to the second movable piece 31 which is a rigid body. However, the present invention is not necessarily limited as such. Alternatively, for example, a curved member, which is a rigid body, can be attached to a second movable piece 31 which is made of an elastic member. The curved member has, for example, a shape similar to that of the flat spring 33. According to this configuration also, the second movable piece 31, which is an elastic body, is elastically deformed by causing the sliding part 6*d* of the plunger 6 to press the curved member which is a rigid body. This makes it possible to elastically press the second movable contact 31*a* against the second fixed contact 31*b*.

Figure 1:
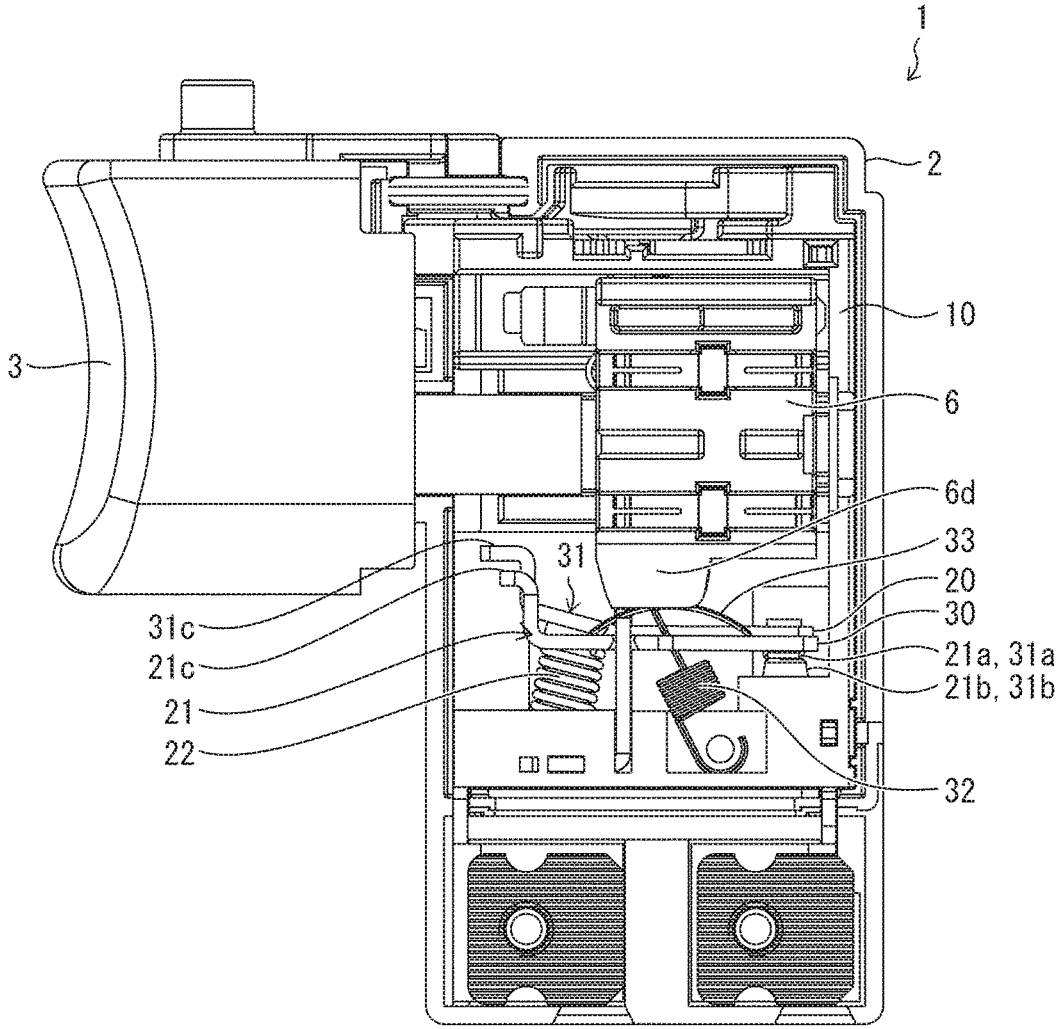
FIG. 1 is a left side view illustrating an embodiment of a trigger switch of the present invention and showing that a plunger is pressing down a flat spring of a second switch while respective contacts of a first switch and of the second switch of the trigger switch are both closed.
Figure 7:
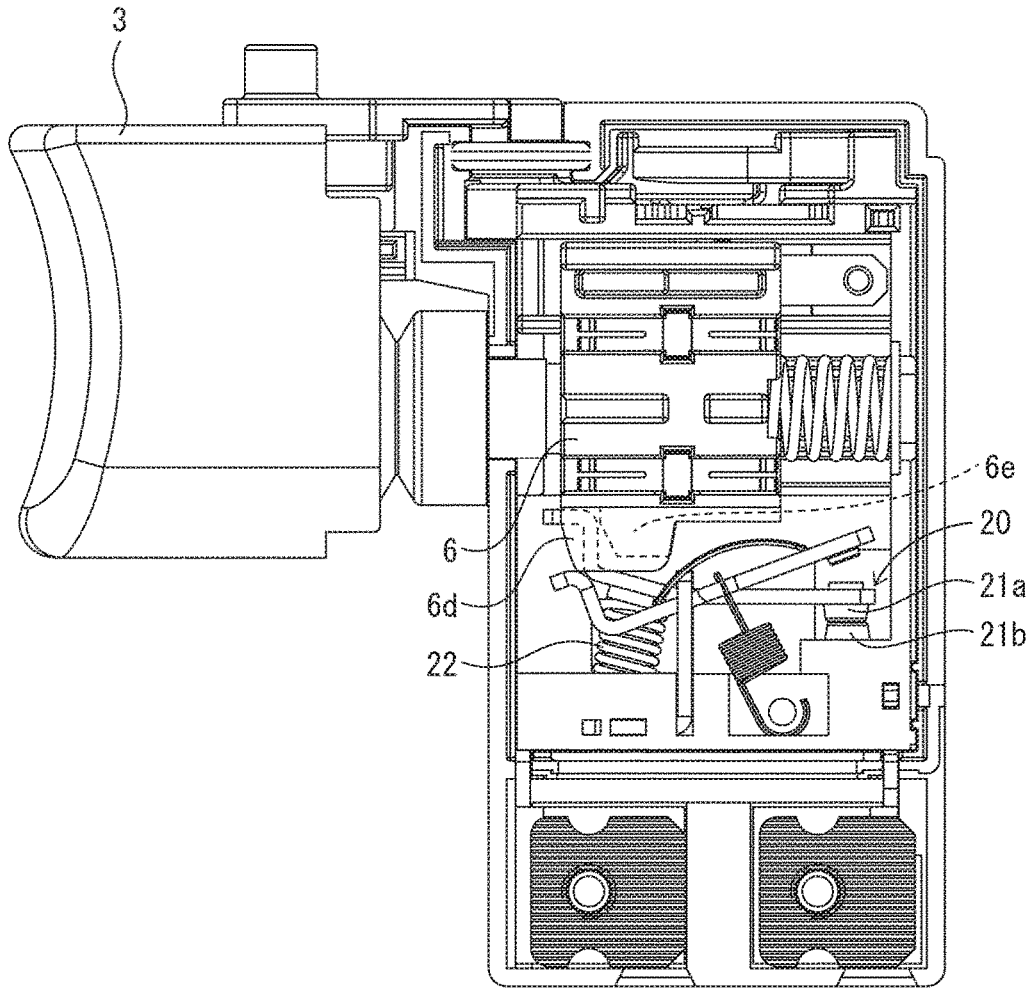
FIG. 7 is a left side view illustrating the configuration of the trigger switch and showing that the contact of the first switch and the contact of the second switch are closed and opened, respectively.
Figure 8:
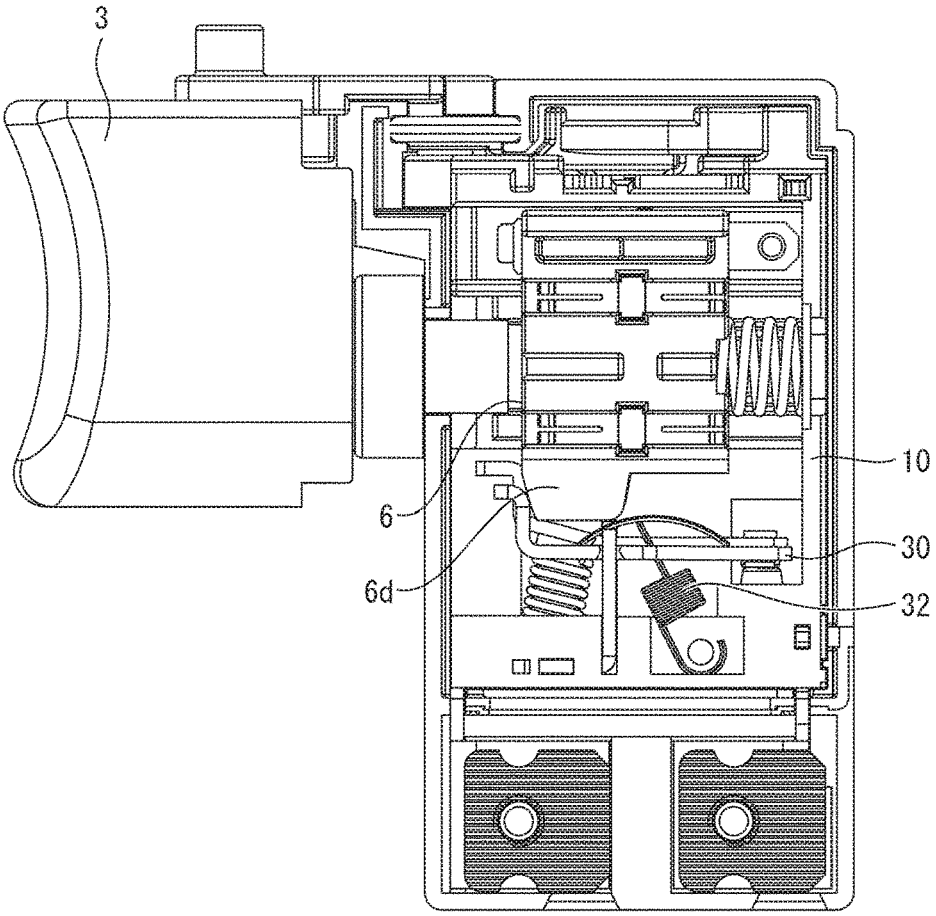
FIG. 8 is a left side view illustrating the configuration of the trigger switch and showing that the contact of the first switch and the contact of the second switch are both closed.

FIG. 7 is a left side view illustrating an internal configuration of the trigger switch 1 and showing that the contact of the first switch 20 and the contact of the second switch 30 are closed and opened, respectively. FIG. 8 is a left side view illustrating the internal configuration of the trigger switch 1 and showing that the contact of the first switch 20 and the contact of the first switch 20 are both closed. FIG. 1 is a left side view showing that the sliding part 6*d* of the plunger 6 is pressing down the flat spring 33 of the second switch 30 while the respective contacts of the first switch 20 and of the second switch 30 of the trigger switch 1 are both closed. The operation of the trigger switch thus configured will be described below with reference to FIGS. 2, 3, 7, 8, and 1.

As illustrated in FIG. 2, while the switching lever 4 is present in a neutral position of the trigger switch 1, the tip part of the switching lever 4 is in contact with the center protrusion 3*a* of the trigger 3. This prevents the trigger 3 from retracting, and therefore presents an operation error.

In so doing, as illustrated in FIG. 3, the respective contacts of the first switch 20 and of the second switch 30 are both opened inside the housing 2.

In this state, turning the switching lever 4 counterclockwise with the turning shaft part 4*a* serving as a fulcrum allows the tip part of the switching lever 4 to loosely fit into the loose-fitting recess 3*c* located between one side surface wall 3*b* and the center protrusion 3*a* of the trigger 3. This allows the trigger 3 to be retractable into the housing 2. Note that immediately before the trigger 3 retracts, the sliders 6*c* and 6*c* come into contact, at a maximum resistance, with the slide resistive element (not shown) of the printed circuit board 8.

According to the first switch 20, the first coil spring 22 (compression spring) elastically applies a force to the first movable piece 21. This causes a clockwise turning force to be applied to the first movable piece 21 in the state illustrated in FIG. 3. However, the sliding part 6*e* of the plunger 6, to which plunger 6 the resetting coil spring 3*f* applies a force, is in contact with the first inhibiting part 21*c* of the first movable piece 21. This restricts the turning of the first movable piece 21. Consequently, the first switch 20 is in an opened state while there is a space between the first movable contact 21*a* and the first fixed contact 21*b*.

Similarly, according to the second switch 30, the second coil spring 32 (extension spring) elastically applies a force to the second movable piece 31. This causes a clockwise turning force to be applied to the second movable piece 31 in FIG. 3. However, the sliding part 6*d* of the plunger 6, to which plunger 6 the resetting coil spring 3*f* applies a force, is in contact with the second inhibiting part 31*c* of the second movable piece 31. This restricts the turning of the second movable piece 31. Consequently, the second switch 30 is in an opened state while there is a space between the second movable contact 31*a* and the second fixed contact 31*b*.

In a case where, in this state, a worker causes the trigger 3 to retract, the plunger 6 engaged with the operation shaft 3*d* slides backward (in a direction toward the right side in FIG. 3). Consequently, the sliders 6*c* and 6*c* combined with the plunger 6 slide on the printed circuit board 8. As a result of the sliding of the sliders 6*c* and 6*c*, the resistance gradually becomes small, so that a flow of an electric current increases. This causes an operation lamp or the like (not shown) to be turned on.

As illustrated in FIG. 7, causing the trigger 3 to further retract causes the sliding part 6*e* of the plunger 6 to be no longer in contact with the first inhibiting part 21*c* of the first switch 20. This causes the first movable piece 21 to be turned clockwise (in FIG. 7) by the spring force of the first coil spring 22. This causes the first movable contact 21*a* to come into contact with the first fixed contact 21*b*. Consequently, the first movable contact 21*a* is pressed against the first fixed contact 21*b* only by the spring force of the first coil spring 22.

As illustrated in FIG. 8, causing the trigger 3 to further retract causes the operation shaft 3*d* to be pushed deeper into the base 10. This causes the sliding part 6*d* to be no longer in contact with the second inhibiting part 31*c* of the second switch 30. This causes the second movable piece 31 to be turned clockwise (in FIG. 8) by the spring force of the second coil spring 32. This causes the second movable contact 31*a* to come into contact with the second fixed contact 31*b*. In this stage, the sliding part 6*d* is not in contact with the flat spring 33, so that the second movable contact 31*a* is pressed against the second fixed contact 31*b* only by the spring force of the second coil spring 32.

Causing the trigger 3 to further retract than is illustrated in FIG. 8 causes the operation shaft 3*d* to be pushed even deeper into the base 10 as illustrated in FIG. 1. This causes the sliding part 6*d* to come into contact with the flat spring 33 provided on the second switch 30. This causes the sliding part 6*d* to press the flat spring 33 toward the second movable contact 31*a*. Due to the elastic force of the flat spring 33, the second movable contact 31*a* is further pressed against the second fixed contact 31*b*. This causes a further increase in contact force between the second movable contact 31*a* and the second fixed contact 31*b*. In so doing, the resistance, which changes in accordance with the sliding, becomes minimum, so that a maximum electric current flows through the sliders 6*c* and 6*c*. This causes a microcomputer (not shown) to output a signal so as to cause the rotation speed of the motor (target of driving; not shown) to be maximum.

According to the trigger switch 1 of the present embodiment, therefore, the contact force of the second switch 30 is increased by the flat spring 33 while the second switch 30 is in a closed state.

In this state, in a case where a worker reduces a force which causes the trigger 3 to retract, the plunger 6 is pushed back by the spring force of the resetting coil spring 3*f*. This causes the sliders 6*c* and 6*c* to slide in a reverse direction on the printed circuit board 8. Then, because the sliding part 6*d* causes the second movable piece 31 of the second switch 30 to turn in a reverse direction, the second movable contact 31*a* of the second switch 30 becomes separated from the second fixed contact 31*b*. Subsequently, by the force of the sliding part 6*d*, the first movable piece 21 turns against the spring force of the first coil spring 22. This causes the first movable contact 21*a* to become separated from the first fixed contact 21*b*.

In addition, turning the switching lever 4 clockwise from the neutral position with the turning shaft part 4*a* serving as a center point allows the tip part of the switching lever 4 to loosely fit into the loose-fitting recess 3*c* located between the other side surface wall 3*b* and the center protrusion 3*a* of the trigger 3. Therefore, causing the trigger 3 to retract as described earlier causes the motor to rotate in the reverse direction.

Figure 9:
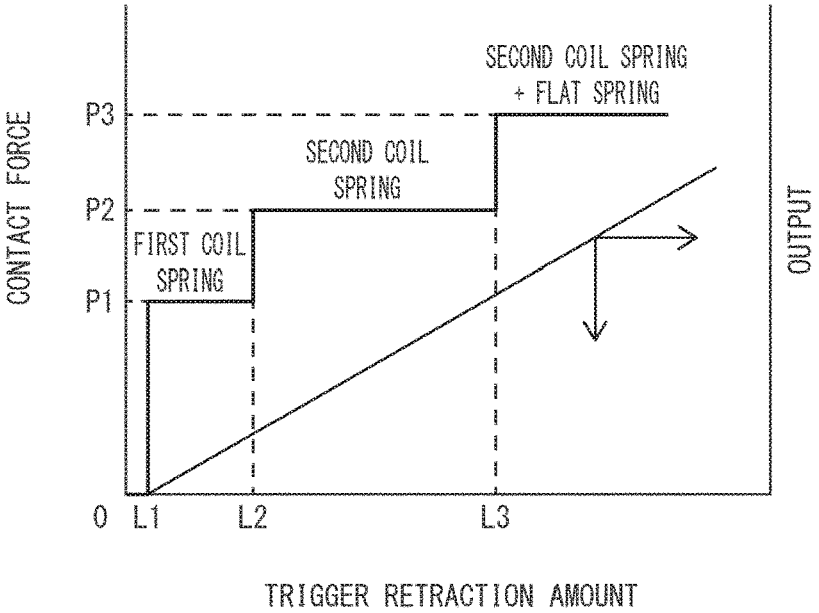
FIG. 9 is a graph showing the following relationships in the trigger switch: (i) a relationship between (a) a retraction amount of the trigger of the trigger switch and (b) respective contact forces of the first switch and of the second switch and (ii) a relationship between (a) the retraction amount of the trigger and (b) an output.

FIG. 9 is a graph showing the following relationships in the trigger switch 1: (i) a relationship between (a) the retraction amount of the trigger 3 and (b) the respective contact forces of the first switch 20 and of the second switch 30 and (ii) a relationship between (a) the retraction amount of the trigger 3 and (b) an output. The following description will discuss, with reference to FIG. 9, (i) the relationship between (a) the respective contact forces of the first switch 20 and of the second switch 30 and (b) the retraction amount of the trigger 3 and (ii) the relationship between (a) the retraction amount of the trigger 3 and (b) the motor output. These relationships are caused by the above-described operation of the trigger switch 1 of the present embodiment. The horizontal axis indicates the retraction amount of the trigger 3. The left vertical axis indicates the contact force. The right vertical axis indicates the motor output. An increase in motor output leads to, for example, an increase in the rotation speed of the motor of the electric power tool, and consequently leads to an increase in vibration.

As illustrated in FIG. 9, while the movement amount of the trigger 3 is between a retraction amount of 0 and a first retraction amount L1, (i) the first switch 20 and the second switch 30 are each opened, (ii) the contact force of each of the first switch 20 and of the second switch 30 is 0, and (iii) the motor output is 0.

After the movement amount of the trigger 3 exceeds the first retraction amount L1 and until the movement amount reaches a second retraction amount L2, (i) the first switch 20 is closed and (ii) the second switch 30 is opened. The first movable contact 21*a* of the first switch 20 is pressed against the first fixed contact 21*b* only by the spring force of the first coil spring 22. Consequently, the contact force of the first switch 20 is maintained at a contact force P1. Note that the motor output (indicated by the oblique solid line in FIG. 9) increases in accordance with an increase in movement amount of the trigger 3.

Subsequently, after the movement amount of the trigger 3 exceeds the second retraction amount L2 and until the movement amount reaches a third retraction amount L3, (i) the first switch 20 remains closed and (ii) the second switch 30 is closed. The second movable contact 31*a* of the second switch 30 is pressed against the first fixed contact 21*b* only by the spring force of the second coil spring 32. Note that the second movable contact 31*a* is pressed against the second fixed contact 31*b* by a contact force P2 which is stronger than the contact force P1 of the first switch 20. Note also that the first coil spring 22 and the second coil spring 32 are not fixed to the plunger 6 or the sliding part 6*d*. The respective spring forces of the first coil spring 22 and of the second coil spring 32 are not applied to the plunger 6 or to the sliding part 6*d*. This prevents a user from feeling tactile feedback.

After the movement amount of the trigger 3 exceeds the third retraction amount L3, the sliding part 6*d* is in contact with the flat spring 33. This (i) causes the first switch 20 to remain closed with the contact force P1 and (ii) causes the second switch 30 to remain closed with a contact force P3 which is stronger than the contact force P2. The second movable contact 31*a* of the second switch 30 is pressed against the second fixed contact 31*b* not only by the spring force of the second coil spring 32 but also by a force of the sliding part 6*d* to press against the flat spring 33. For simplicity, FIG. 9 shows that the contact force rises up to the contact force P3 at the third retraction amount L3. Note, however, that, the contact force of the second switch 30 may rise gradually after reaching the third retraction amount L3. Specifically, in a case where the movement amount of the trigger 3 (movement amount of the sliding part 6*d*) increases further than the third retraction amount L3, the contact force may continuously increase from the contact force P2 to the contact force P3 in accordance with an increase in movement amount. This is because the flat spring 33 has a surface (curved surface) inclined with respect to the moving direction of the sliding part 6*d* of the plunger 6, and consequently the sliding part 6*d* comes into contact with the surface of the flat spring 33 thus inclined. Note that the curved surface of the flat spring 33, into which the sliding part 6*d* comes into contact, is curved so as to protrude. Therefore, while the surface of the flat spring 33, with which the sliding part 6*d* is in contact, is parallel to the moving direction of the sliding part 6*d* (as illustrated in FIG. 1), the contact force becomes constant.

While the motor output is large, the vibration of an electric power tool is also large. It is therefore necessary to increase the contact force of a switch. According to the trigger switch 1, the contact of the second switch 30 remains closed due to a resultant force of the spring force of the second coil spring 32 and the force of the flat spring 33. Even in a case where the first switch 20 is temporarily opened due to the vibration, the second switch 30, to which a stronger contact force is applied, remains closed. This prevents the occurrence of chattering or arc discharge. In addition, the first movable contact 21*a*, which has a silver contact that makes it easy to prevent arc discharge during an opening motion, is not pressed against the first fixed contact 21*b* by a force which is stronger than necessary. It is therefore possible to prevent the deformation of the silver contact and consequently improves durability.

In addition, since the sliding part 6*d* comes into contact with the flat spring 33 which elastically deforms, it is possible to restrict the tactile feedback when the trigger 3 retracts. Furthermore, in a case where the sliding part 6*d* moves, the sliding part 6*d* comes into contact with the surface of the flat spring 33, which surface is inclined with respect to the moving direction of the sliding part 6*d*. It is therefore possible to further restrict the tactile feedback when the trigger 3 retracts.

According to the present embodiment, therefore, it is possible to increase a contact force so as to improve a vibration resistance. In addition, according to the present embodiment, it is possible to provide the trigger switch 1 which has no tactile feedback and in which a contact force may increase in response to a retraction amount of the trigger 3.

(Variations)

According to an aspect of the present invention, it is possible to use a torsion coil spring instead of the flat spring 33. It is possible that two arms of the torsion coil spring are fixed so that (i) one arm is fixed to one attachment recess 31*d* of a second movable piece 31 and (ii) the other arm is fixed to the other attachment recess 31*d* of the second movable piece 31. Since a sliding part 6*d* presses a coil part or the like of the coil spring, an effect similar to that of the embodiment above can be produced.

Alternatively, it is possible to use an elastic member (spring, rubber, or the like) instead of the flat spring 33. An elastic member is provided on a second movable piece 31. Then, a sliding part 6*d* presses the elastic member to cause the elastic member to elastically deform. The elastic member, which has elastically deformed, presses a second movable contact 31*a* against a second fixed contact 31*b*, as in the case of the flat spring 33. The elastic member can have a surface which is inclined with respect to a moving direction of the sliding part 6*d*. In such a case, it is possible to (i) prevent an increase in necessary operating force and (ii) press the second movable contact 31*a* against the second fixed contact 31*b*. Alternatively, as in the case of the flat spring 33, the elastic member can have a curved surface which is curved so as to protrude.

Note that although the present specification discussed an example in which the trigger switch 1 is included in an electric power tool, the present invention is not limited to such an example. Alternatively, the trigger switch 1 can be provided to any machine in addition to such a tool. Although the present specification discussed an example in which the switch opening-closing mechanism 7 is included in the trigger switch 1, the present invention is not limited such an example. Alternatively, the switch opening-closing mechanism 7 can be used as a switch of any machine. Although the present specification discussed an example in which the switch opening-closing mechanism 7 includes a first switch and a second switch, the present invention is not limited to such an example. Alternatively, for example, the switch opening-closing mechanism 7 can be configured to include a second switch but not a first switch.

The present invention is not limited to the embodiments, but can be altered by a skilled person in the art within the scope of the claims. The present invention also encompasses, in its technical scope, any embodiment derived by combining technical means disclosed in differing embodiments.

As has been described, a switch contact structure in accordance with an aspect of the present invention includes: an operation section; a first movable contact member; and a first counter contact member configured to face the first movable contact member, in a case where an amount of movement of the operation section reaches a first movement amount, the first movable contact member coming into contact with the first counter contact member due to a spring force applied to the first movable contact member, and in a case where the amount of movement of the operation section reaches a second movement amount which is larger than the first movement amount, the operation section pressing the first movable contact member against the first counter contact member.

With the configuration, it is possible to increase a contact force between the first movable contact member and the first counter contact member so as to improve a vibration resistance.

The contact structure in accordance with an aspect of the present invention can be configured so that: the first movable contact member includes an elastic member; and in a case where the amount of movement of the operation section reaches the second movement amount, the operation section presses the first movable contact member so as to cause the elastic member to elastically deform.

According to the configuration, the elastic member elastically deforms. This prevents a repulsive force, which is applied to the operation section, from sharply becoming large. It is therefore possible to increase the contact force while good operability is maintained. Hence, tactile feedback during operation can be restricted.

The contact structure in accordance with an aspect of the present invention can be configured so that in a case where the amount of movement of the operation section reaches the second movement amount, the operation section comes into contact with the elastic member.

With the configuration, it is possible to (i) reduce an effect on an operating load and (ii) increase the contact force as necessary.

The contact structure in accordance with an aspect of the present invention configured so that: the elastic member has an inclined surface which is inclined with respect to a direction in which the operation section moves; and the operation section is configured to come into contact with the inclined surface.

According to the configuration, the operation section comes into contact with the inclined surface. This prevents a repulsive force, which is applied to the operation section, from sharply becoming large.

The contact structure in accordance with an aspect of the present invention configured so that: the elastic member has a curved surface which is curved so as to protrude; and the operation section is configured to come into contact with the curved surface.

According to the configuration, the operation section comes into contact with the curved surface. This allows a change in operating load to be continuous. It is therefore possible to achieve good operability.

The contact structure in accordance with an aspect of the present invention configured so that the elastic member is a flat spring.

With the configuration, good operability and a high durability can be achieved with a simple configuration.

The contact structure in accordance with an aspect of the present invention configured so that the elastic member is a torsion coil spring.

The contact structure in accordance with an aspect of the present invention configured so that in a case where the amount of movement of the operation section further increases so as to be more than the second movement amount, a force by which the first movable contact member is pressed against the first counter contact member increases.

According to the configuration, a repulsive force, which is applied to the operation section, is prevented from sharply becoming large.

The contact structure in accordance with an aspect of the present invention can be configured to further include: a second movable contact member; and a second counter contact member configured to face the second movable contact member, in a case where the amount of movement of the operation section reaches a third movement amount which is smaller than the first movement amount, the second movable contact member coming into contact with the second counter contact member due to a spring force applied to the second movable contact member.

With the configuration, it is possible to separate the following (i) and (ii) from each other: (i) the second movable contact member and the second counter contact member which are configured to open and close the switch (i.e., to which arc discharge may occur) and (ii) the first movable contact member and the first counter contact member which are configured to maintain the closed state of the switch. It is therefore possible to improve the durability of the contact structure.

A trigger switch in accordance with an aspect of the present invention can be configured to include: the contact structure in accordance with the aspect of the present invention, the operation section being configured to move in coordination with a trigger operated by a user.

An electric power tool in accordance with an aspect of the present invention can be configured to include the trigger switch in accordance with the aspect of the present invention.

REFERENCE SIGNS LIST

1 Trigger switch
2 Housing
3 Trigger
4 Switching lever
4*a* Turning shaft part
6 Plunger (operation section)
6*d*, 6*e* Sliding part (operation section)
7 Switch opening-closing mechanism (switch contact structure)
8 Printed circuit board
10 Base
20 First switch
21 First movable piece (second movable contact member)
21*a* First movable contact
21*b* First fixed contact (second counter contact member)
21*c* First inhibiting part
22 First coil spring
30 Second switch
31 Second movable piece (first movable contact member)
31*a* Second movable contact
31*b* Second fixed contact (first counter contact member)
31*c* Second inhibiting part
32 Second coil spring
33 Flat spring (elastic member)

What is claimed is:

1. A switch contact structure comprising:

an operation section;

a first movable contact member, the first movable contact member including an elastic member; and a first counter contact member configured to face the first movable contact member, wherein the operation section is configured such that:

in a case where an amount of movement of the operation section reaches a first movement amount, the first movable contact member coming into contact with the first counter contact member due to a spring force applied to the first movable contact member, and in a case where the amount of movement of the operation section reaches a second movement amount which is larger than the first movement amount, the operation section comes into contact with the elastic member, the operation section pressing the first movable contact member so as to cause the elastic member to elastically deform, and the operation section pressing the first movable contact member against the first counter contact member.

2. The switch contact structure as set forth in claim 1 wherein:

the elastic member has an inclined surface which is inclined with respect to a direction in which the operation section moves; and the operation section is configured to come into contact with the inclined surface.

3. The switch contact structure as set forth in claim 1, wherein:

the elastic member has a curved surface which is curved so as to protrude; and the operation section is configured to come into contact with the curved surface.

4. The switch contact structure as set forth in claim 1, wherein the elastic member is a flat spring.

5. The switch contact structure as set forth in claim 1, wherein the elastic member is a torsion coil spring.

6. The switch contact structure as set forth in claim 1, wherein the operation section is further configured such that:

in a case where the amount of movement of the operation section further increases so as to be more than the second movement amount, a force by which the first movable contact member is pressed against the first counter contact member increases.

7. The switch contact structure as set forth in claim 1, further comprising:

a second movable contact member; and a second counter contact member configured to face the second movable contact member, wherein the operation section is further configured such that:

in a case where the amount of movement of the operation section reaches a third movement amount which is smaller than the first movement amount, the second movable contact member coming into contact with the second counter contact member due to a spring force applied to the second movable contact member.

8. A trigger switch comprising:

a switch contact structure recited in claim 1, the operation section being configured to move in coordination with a trigger operated by a user.

9. An electric power tool comprising:

a trigger switch recited in claim 8.

10. A switch contact structure comprising:

an operation section;

a first movable contact member; and a first counter contact member configured to face the first movable contact member, the first movable contact member including an elastic member, wherein the operation section is configured such that:

in a case where an amount of movement of the operation section reaches a first movement amount, the first movable contact member coming into contact with the first counter contact member due to a spring force applied to the first movable contact member, and in a case where the amount of movement of the operation section reaches a second movement amount which is larger than the first movement amount, the operation section pressing the first movable contact member so as to cause the elastic member to elastically deform, and the operation section pressing the first movable contact member against the first counter contact member, and wherein the elastic member being a flat spring.

11. The switch contact structure as set forth in claim 10, wherein the operation section is further configured such that:

in a case where the amount of movement of the operation section further increases so as to be more than the second movement amount, a force by which the first movable contact member is pressed against the first counter contact member increases.

12. The switch contact structure as set forth in claim 10, further comprising:

a second movable contact member; and a second counter contact member configured to face the second movable contact member, wherein the operation section is further configured such that:

in a case where the amount of movement of the operation section reaches a third movement amount which is smaller than the first movement amount, the second movable contact member coming into contact with the second counter contact member due to a spring force applied to the second movable contact member.

13. A trigger switch comprising:

a switch contact structure recited in claim 10, the operation section being configured to move in coordination with a trigger operated by a user.

14. An electric power tool comprising:

a trigger switch recited in claim 13.

* * * * *